US006271873B1

(12) United States Patent
Sambongi

(10) Patent No.: US 6,271,873 B1
(45) Date of Patent: Aug. 7, 2001

(54) THERMAL HEAD

(75) Inventor: Norimitsu Sambongi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/629,668

(22) Filed: Aug. 1, 2000

(30) Foreign Application Priority Data

Aug. 2, 1999 (JP) ..... 11-218352

(51) Int. Cl.[7] ..... B41J 2/335; B41J 2/345
(52) U.S. Cl. ..... 347/208; 347/209
(58) Field of Search ..... 347/208, 209

(56) References Cited

U.S. PATENT DOCUMENTS 4,841,120 * 6/1989 Yagino et al. ..... 347/209
5,477,266 12/1995 Shirakawa ..... 347/208

FOREIGN PATENT DOCUMENTS 57-64577 * 4/1982 (JP) ..... 347/209
4-319448 * 11/1992 (JP) ..... 347/209

OTHER PUBLICATIONS

Patent Abstract of Japan, vol. 016, No. 414 (M–1303) Sep. 2, 1992.
Patent Abstract of Japan, vol. 017, No. 144 (M–1386) Mar. 23, 1993.
Patent Abstract of Japan, vol. 014, No. 361 (M–1006) Aug. 6, 1990.
Patent Abstract of Japan, vol. 012, No. 340 (M–740) Sep. 13, 1988.
Patent Abstract of Japan, vol. 015, No. 253 (M–1129) Jun. 27, 1991.
Patent Abstract of Japan, vol. 011, No. 205 (M–603) Jul. 3, 1987.

* cited by examiner

*Primary Examiner*—Huan Tran
(74) *Attorney, Agent, or Firm*—Adams & Wilks

(57) ABSTRACT

A thermal head has an insulating substrate having a first main surface and a second main surface opposite the first main surface, and an end surface. Heater resistors are arranged in a line on the first surface of the insulating substrate. Driving elements are disposed on the second main surface of the insulating substrate for driving the heater resistors. The heater resistors are electrically connected to the driving elements by turnup connection terminals.

13 Claims, 5 Drawing Sheets

THERMAL HEAD

BACKGROUND OF THE INVENTION

1. Field of the invention

The present invention relates to a thermal head for use in thermal recording in a facsimile machine, a printer, or the like.

2. Description of the Related Art

In a conventional thermal head, as shown in FIG. 5, an individual electrode 3 connected to one end of a heater resistor 2 is connected to a driving element 5. The other end of the heater resistor 2 is connected to a common electrode 4. All of these components are provided on the same plane on an insulating substrate 1.

The individual electrode 3 and the driving element 5 are connected by wire bonding or flip chip. The driving element 5 and the connecting portion are, for protection, encapsulated with an encapsulation on the periphery of the driving element using an epoxy resin or the like. The encapsulation covers the whole of the driving element 5 and the connecting portion, and further, for the purpose of securing a reliability, has a width and the height which are larger than those of the driving element 5 and the connecting portion. Thus, in order to avoid interference with a platen for advancing paper by rotating together with the paper, the position of the encapsulation is required to be apart from the heater resistor 2 by a predetermined distance. However, on the other hand, in order to lower the cost of the thermal head, it is necessary to make the width of the substrate as small as possible to increase the number of the thermal heads taken from one process unit substrate. Therefore, for example, is made the platen diameter as small as possible to avoid the interference, to realize both decrease in the width of the substrate and to avoid interference between the encapsulation, the paper 9 and the platen 8. However, making the platen diameter small has problems such as insufficient strength and deflection of the platen and a decrease in the amount of collapse (contact area with the paper) by pressing pressure, and thus, is adversely affected the printing quality. Therefore, about 5 mm to 10 mm is thought to be the lower limit of the platen diameter, which means that, in order to avoid the interference with the encapsulation, it is not possible to make the width of the substrate smaller beyond a certain extent.

Since, by the foregoing construction paper is inserted so as to keep out of the encapsulated portion, the paper insert path is curved, and thus, hard cardboard, plastic paper which is difficult to fold, and the like can not be used for printing. Therefore, conventionally, with regard to these kinds of paper which are difficult to fold, in order to secure a straight path (a straight paper insert path), an end face type thermal head as shown in FIG. 6 is provided where the heater resistor 2 is provided on an end face of the substrate and the driving element 5 is provided perpendicularly to the heater resistor 2 and a near edge type thermal head as shown in FIG. 7 where the interference with the encapsulated portion is avoided by providing the heater resistor 2 at an edge portion of the substrate and slanting the thermal head. Further, recently, a method has been thought of where, as shown in FIG. 8, a concave portion is processed in a part of the insulating substrate 1 such that a step is provided in the substrate itself for making a portion where the driving element 5 is provided lower than the heater resistor 2.

However, with regard to all of the above-described methods, since the shape of the substrate is complicated, its processing is difficult, and, since its patterning has to be carried out with regard to different surfaces or a surface having a great step, the manufacturing method is complicated and it is difficult to lower the cost.

SUMMARY OF THE INVENTION

In order to solve these problems, according to the present invention, by carrying out electric connection between front and rear surfaces of a substrate using through hole connection or turnup terminal connection, a driving element can be provided on the rear surface of a heater resistor.

By the present invention, there is no encapsulation on the side where the heater is provided, a straight path which is completely flat can be materialized, and there is no interference between a platen and paper and encapsulation. Therefore, the substrate size can be made smaller. Further, though, conventionally, the platen diameter has to be made smaller to make the thermal head size smaller, a necessary platen diameter can be selected independently of the width of the substrate. Still further, by providing the driving element on the rear surface, an area for the provision of the driving element which is conventionally necessary becomes unnecessary, and the width of the substrate can be made further smaller.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Embodiment 1

An embodiment of the present invention is described in detail as follows based on the drawings.

Figure 1:
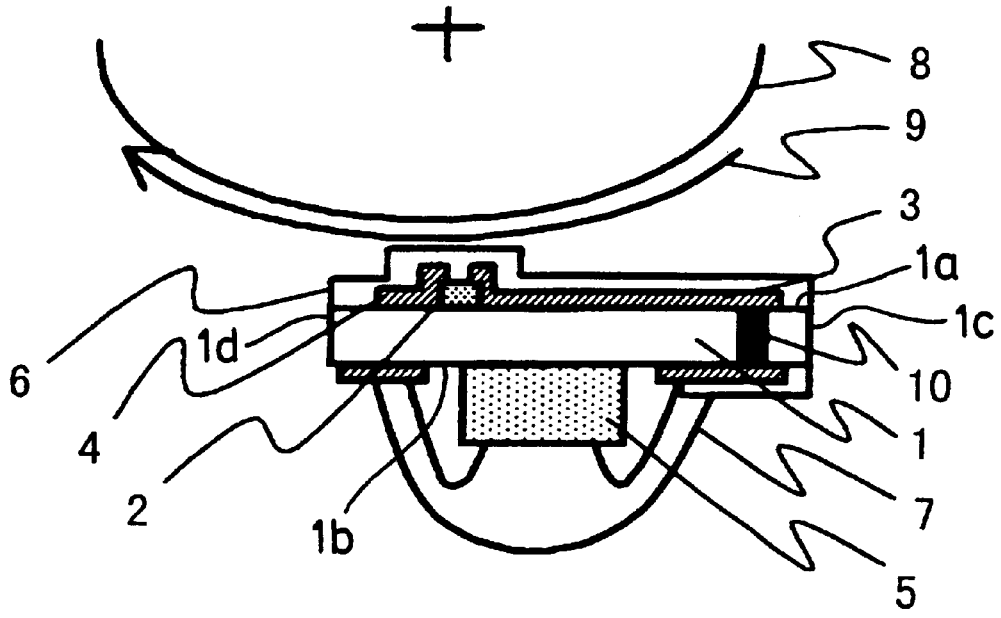
FIG. 1 is a cross-sectional view of a thermal head in case through hole connection is used according to the present invention.
Figure 3A:
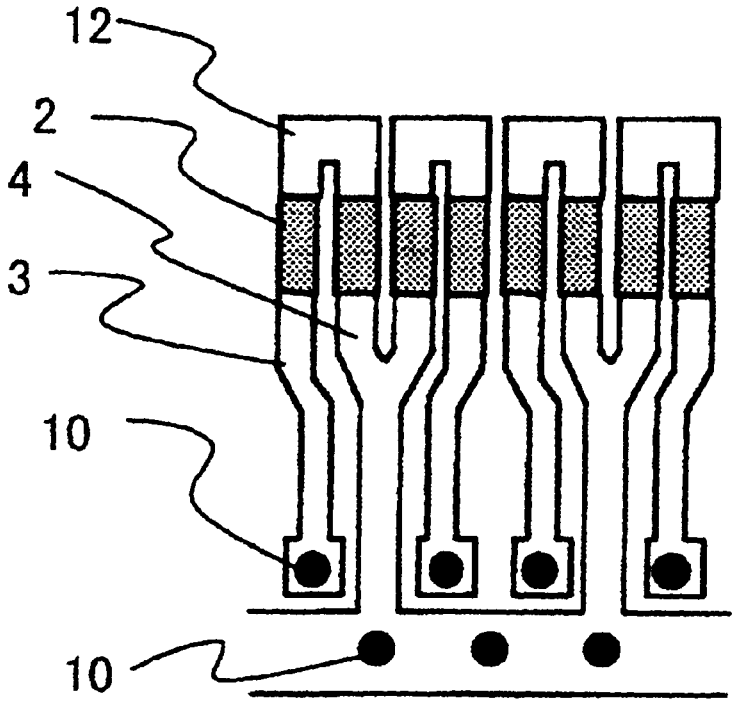
FIG. 3 is a plan view of the thermal head in case the through hole connection is used according to the present invention.

FIG. 1 is a cross-sectional view of an embodiment using a through hole connection. As shown in FIG. 3A, the thermal head is of a U-turn electrode constitution where two heater resistors form one dot.

In FIG. 1, an insulating substrate 1 has opposite first and second main surfaces 1*a*, 1*b* (hereinafter "front surface side" and "rear surface side", respectively) and first and second side surfaces 1*c*, 1*d* (hereinafter "end faces") of two heater resistors 2 with each pair forming one dot are arranged in a line on the front surface side 1*a* of the insulating substrate 1. One heater resistor 2 of each pair is electrically connected to an individual electrode 3 and the other heater resistor 2 is electrically connected to a common electrode 4 with a U-turn electrode sandwiched between the heater resistors. The periphery is protected by a protective film 6. The end of each of the individual electrodes 3 which is opposite to the end connected to a heater resistor 2 is connected to a through hole 10. Electric connection to the rear surface side of the insulating substrate 1 is carried out through the through hole 10. On the rear surface side 1*b* of the insulating substrate 1, the individual electrode 3 is further extended through each of the through holes 10. Each of the individual electrodes 3 is connected to a driving element 5 by wire bonding a, flip chip, or the like. The driving element 5 and the connecting portion are covered with encapsulation an 7 formed of a resin of an epoxy system or the like.

On the other hand, with regard to the side of the common electrodes 4, all the common electrodes are connected together in a strip-like pattern on one side of the insulating substrate 1. Electric connection to the rear surface side 1*b* of the insulating substrate 1 is carried out through a plurality of through holes in the pattern. When electric current passes from the common electrodes 4 to the individual electrodes 3 selected by the driving element 5, a part of the heater resistors 2 generate heat.

Here, preferably, the diameter of the through holes 10 is 0.05 mm or smaller and the intervals between the through holes are 0.1 mm or smaller. This is because the dot pitch in case the dot density of the heater resistors is 200 DPI (8 dots/mm) is 0.125 mm. However, in actual formation of the through holes, if it is difficult to process such through holes having a small diameter at such a small pitch, it does not matter even if the diameter is 0.05 mm or larger and the intervals between the through holes are 0.1 mm or larger. In that case, it is necessary to effectively arrange the through holes so as to be staggered according to their size. This is also true of in which the dot density is the case of 200 DPI or more.

In order to carry out electric connection between the front and rear surfaces of the insulating substrate through the through holes, a method where the inside of the through holes is filled with a conductor, a method using wet plating, a method using vacuum film formation, or the like is used. It is necessary that the current capacitance of 5–100 mA or more can be secured per through hole.

Figure 3B:
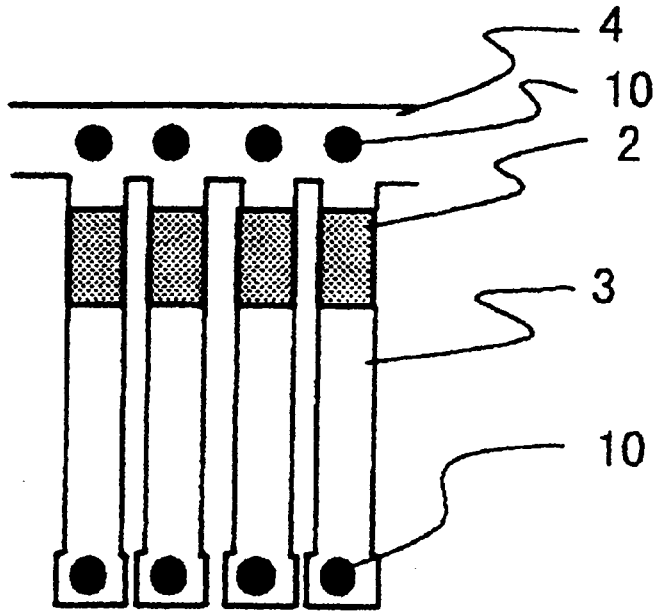

The above description is with regard to the case of the thermal head having the U-turn electrode constitution. However, the same can be said with regard to a thermal head having a common electrode constitution where one dot is formed of one heater resistor as shown in FIG. 3B.

Embodiment 2

Figure 2:
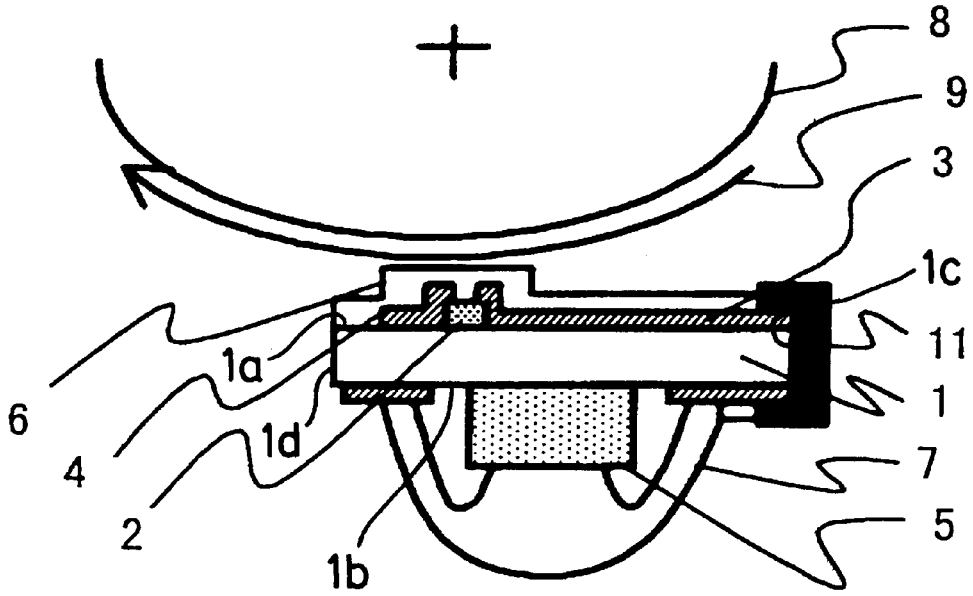
FIG. 2 is a cross-sectional view of a thermal head in case turnup terminal connection is used according to the present invention.
Figure 4A:
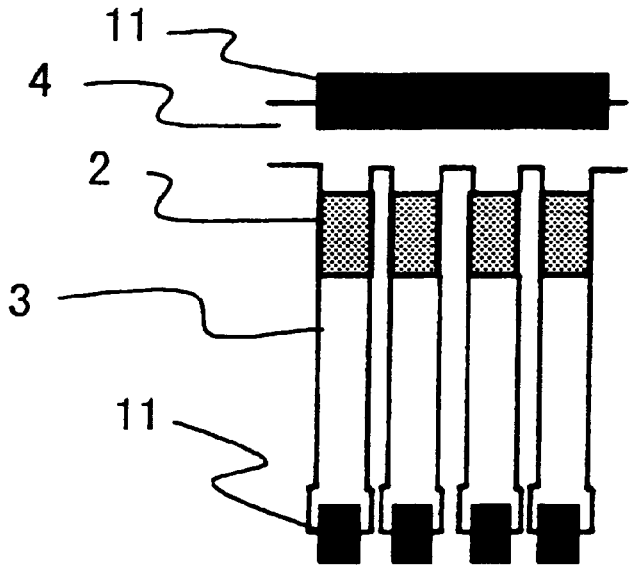
FIG. 4 is a plan view of the thermal head in case the turnup terminal connection is used according to the present invention.

FIG. 2 is across-sectional view of an embodiment using a turnup terminal connection. As shown in FIG. 4A, the thermal head is of a common electrode constitution where one heater resistor forms one dot.

In FIG. 2, heater resistors 2 each forming one dot are arranged in a line on the front surface side of an insulating substrate 1. One end of each heater resistor is electrically connected to an individual electrode 3 and the other end is electrically connected to a common electrode 4. The periphery is protected by a protective film 6. One end of each of the individual electrodes is connected to a heater resistor. The other end extends to the vicinity of an end face of the insulating substrate, and is electrically connected to the rear surface side of the insulating substrate 1 using a turnup connection terminal 11. On the rear surface side, the respective turnup connection terminals are connected so as to make one-to-one correspondence to individual electrodes on the rear surface side. Each of the individual electrodes is connected to a driving element 5 by wire bonding, flip chip, or the like. The driving element and the connecting portion are covered with an encapsulation 7 formed of a resin of an epoxy system or the like.

On the other hand, with regard to the side of the common electrodes, all the common electrodes are connected together in a strip-like pattern on one side of the insulating substrate 1. Electric connection to the rear surface side of the insulating substrate 1 is carried out through the turnup connection terminals in the pattern. By electric current passing from the common electrodes to the individual electrodes selected by the driving element, a part of the heater resistors generate heat.

Here, preferably, the terminal pitch of the turnup connection terminals is 0.1 mm or smaller and the space between terminal widths is sufficient. This is because the dot pitch in case the density of the heater resistors is 200 DPI (8 dots/mm) is 0.125 mm, and for the purpose of avoiding short circuit between adjacent dots due to misalignment when the terminals are connected or misalignment in patterning between the front and rear surfaces. In case of a dot density of 200 DPI or more, turnup connection terminals having a narrower pitch according to the size are necessary. The turnup connection terminals 11 may comprise, for example, a flexible substrate having a printed electrical pattern. In the embodiment shown in FIGS. 1 and 4A–4B, the turnup connection terminals are generally U-shaped.

In order to carry out electric connection between the front and rear surfaces of the insulating substrate through the turnup connection terminals, a method where a flexible pattern circuit (FPC) is used and the connection is carried out by soldering or an anisotropic conductive film, a method where clip-like metal terminals are aligned, a method where the connection is carried out by wire bonding, or the like is used. It is necessary that the current capacitance of 5–100 mA or more can be secured per terminal.

Figure 4B:
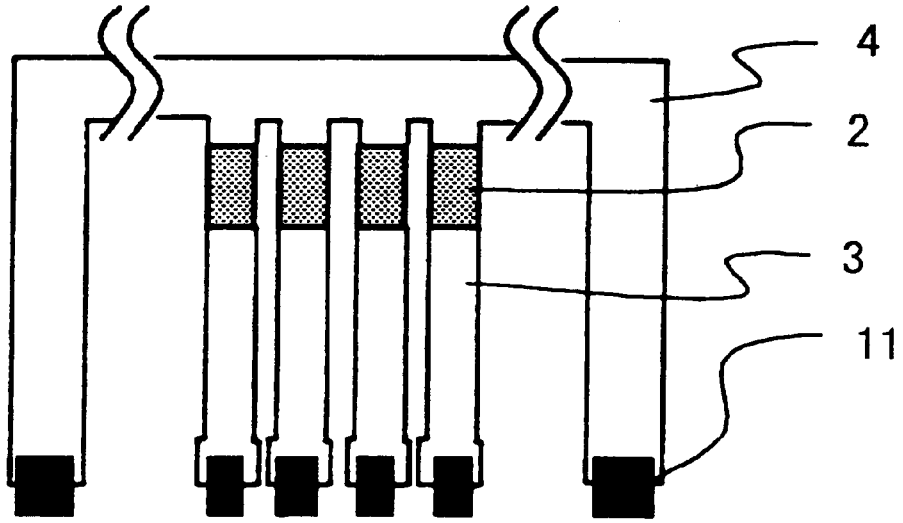
Figure 5:
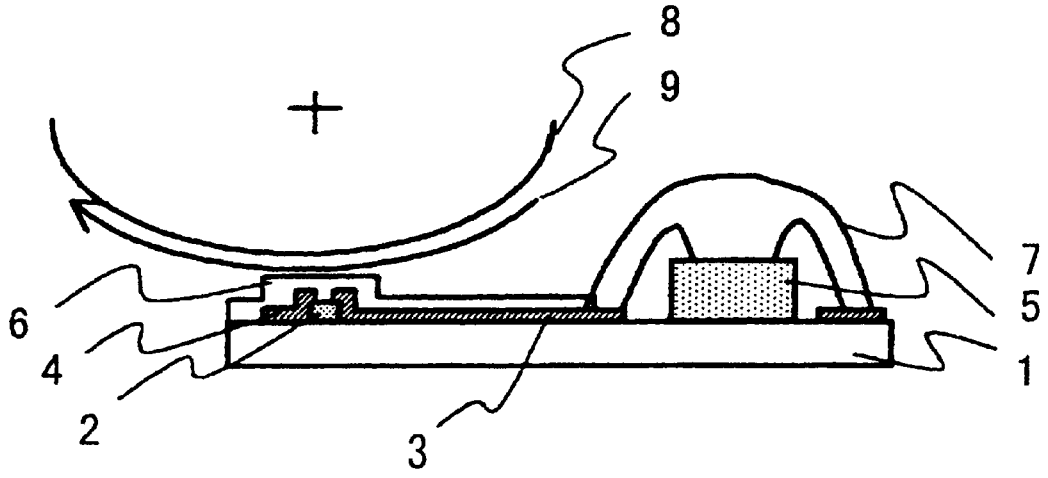
FIG. 5 PRIOR ART
FIG. 5 is a cross-sectional view showing a conventional thermal head.
Figure 6:
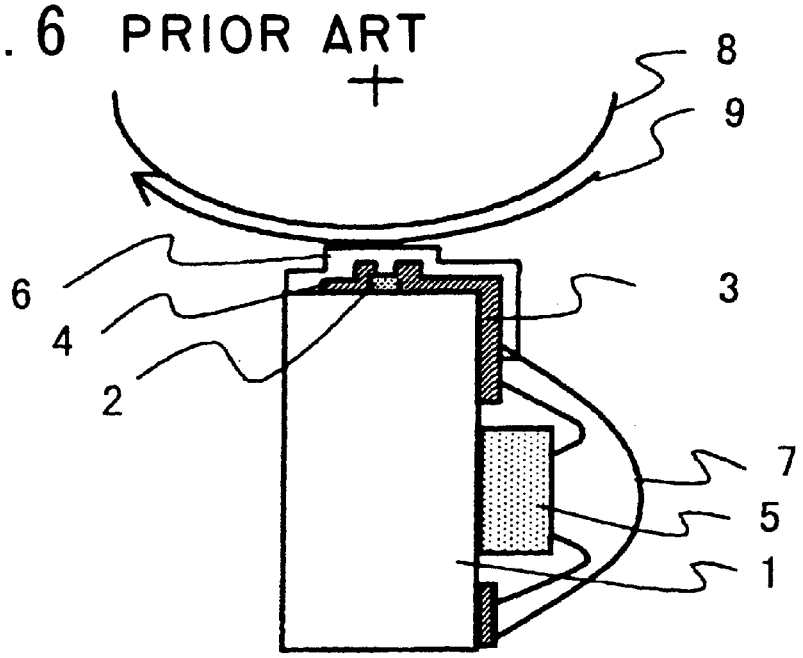
FIG. 6 PRIOR ART
FIG. 6 is a cross-sectional view showing another conventional thermal head.
Figure 7:
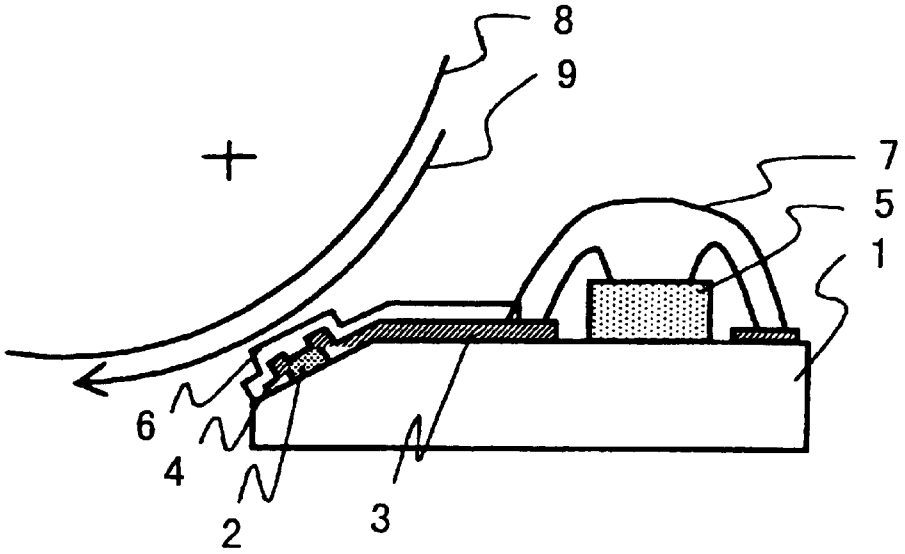
FIG. 7 PRIOR ART
FIG. 7 is a cross-sectional view showing still another convention thermal head.
Figure 8:
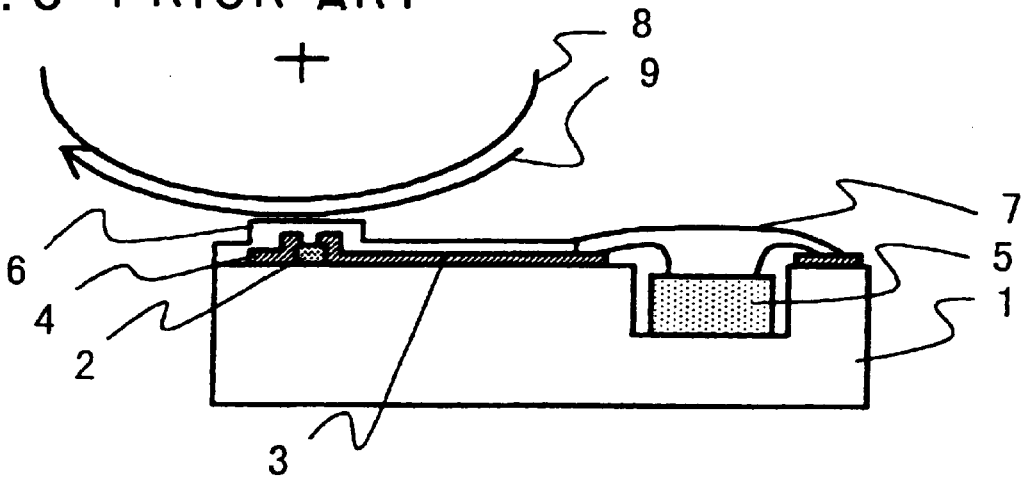
FIG. 8 PRIOR ART
FIG. 8 is a cross-sectional view showing yet still another conventional thermal head.

The above description is with regard to the case of the thermal head having the common electrode constitution where the strip-like common electrode is provided in the vicinity of the heaters. However, the same can be said with regard to a thermal head of a type where common electrodes are wired on both sides of an insulating substrate as shown in FIG. 4B.

By a thermal head according to the present invention, there is no encapsulation on the side where the heaters are provided, and a straight path which is completely flat can be materialized. By providing the driving elements on the rear surface, area for the provision of the driving elements which is conventionally necessary becomes unnecessary on the side where the heater resistors are provided, and the width of the substrate can be made further smaller. Still further, though, conventionally, for the purpose of making the thermal head size smaller, the platen diameter has to be made smaller at the expense of the printing quality, a necessary platen diameter can be selected independently of the width of the substrate, and the degree of freedom in designing the thermal printer is remarkably improved.

Also, furthermore, the shape in going through the manufacturing process is simplified, the number of the thermal heads taken from one process unit substrate is increased, and the productivity is improved, which greatly contributes to lowering of the cost.

What is claimed is:

1. A thermal head comprising: an insulating substrate having a first main surface and a second main surface opposite the first main surface; a plurality of heater resistors disposed in a line on the first surface of the insulating substrate; a plurality of driving elements disposed on the second main surface of the insulating substrate for driving the heater resistors; and a plurality of turnup connection terminals electrically connecting the heater resistors to the driving elements.

2. A thermal head according to claim 1; wherein the turnup connection terminals are disposed on an end surface of the insulating substrate.

3. A thermal head according to claim 1; wherein each of the turnup connection terminals comprises a flexible substrate having a printed electrical pattern.

4. A thermal head according to claim 3; wherein each of the turnup connection terminals is generally U-shaped.

5. A thermal head according to claim 1; wherein each of the turnup connection terminals is generally U-shaped.

6. A thermal head according to claim 1; further comprising a plurality of individual electrodes each having a first portion disposed on the first main surface of the insulating substrate and a second portion disposed on the second main surface of the insulating substrate and electrically connected to the first portion by a respective one of the turnup connection terminals, the first portion of each of the individual electrodes having an end electrically connected to a respective one of the heater resistors, and the second portion of each of the individual electrodes having an end electrically connected to a respective one of the driving elements; and a plurality of common electrodes each having a first portion disposed on the first main surface of the insulating substrate and a second portion disposed on the second main surface of the insulating substrate and electrically connected to the first portion of the common electrode by a respective one of the turnup connection terminals, the first portion of each of the common electrodes having an end electrically connected to a respective one of the heater resistors so that the heater resistors generate heat when electric current from the common electrodes passes through the individual electrodes driven by the driving elements.

7. A thermal head according to claim 6; wherein the common electrodes are connected together in a strip-shaped pattern.

8. A thermal head comprising: an insulating substrate having a first main surface, a second main surface opposite the first main surface, a first side surface, and a second side surface; a plurality of heater resistors disposed in a line on the first main surface of the insulating substrate; a plurality of pairs of individual electrodes each disposed on a respective one of the first and second main surfaces of the insulating substrate, each pair of the individual electrodes being electrically connected to a respective one of the heater resistors; a plurality of pairs of common electrodes each disposed on a respective one of the first and second main surfaces of the insulating substrate, each pair of the common electrodes being electrically connected to a respective one of the pairs of individual electrodes through one of the heater resistors; a plurality of first turnup connection terminals each electrically connecting the individual electrodes of a respective one of the pairs of individual electrodes to one another; a plurality of second turnup connection terminals each electrically connecting the common electrodes of a respective one of the pairs of common electrodes to one another; and a plurality of driving elements for selectively driving the pairs of individual electrodes, each of the driving elements being connected to a respective one of the pairs of individual electrodes so that the heater resistors generate heat by electric current from the pairs of common electrodes passing to the pairs of the individual electrodes driven by the driving elements.

9. A thermal head according to claim 8; wherein the turnup connection terminals are disposed on the first and second side surfaces of the insulating substrate.

10. A thermal head according to claim 8; wherein each of the turnup connection terminals comprises a flexible substrate having a printed electrical pattern.

11. A thermal head according to claim 10; wherein each of the turnup connection terminals is generally U-shaped.

12. A thermal head according to claim 8; wherein each of the turnup connection terminals is generally U-shaped.

13. A thermal head according to claim 8; wherein the common electrodes are connected together in a strip-shaped pattern.

* * * * *